US009307840B2

(12) United States Patent
Restrepo et al.

(10) Patent No.: US 9,307,840 B2
(45) Date of Patent: Apr. 12, 2016

(54) FOLDABLE AND PORTABLE LOUNGE CHAIR HAVING AN INTEGRATED LOCKABLE STORAGE COMPARTMENT

(71) Applicants: Carlos Arturo Restrepo, Largo, FL (US); Julio Cesar Restrepo, Largo, FL (US)

(72) Inventors: Carlos Arturo Restrepo, Largo, FL (US); Julio Cesar Restrepo, Largo, FL (US)

( * ) Notice: Subject to any disclaimer, the term of this patent is extended or adjusted under 35 U.S.C. 154(b) by 13 days.

(21) Appl. No.: 14/321,338

(22) Filed: Jul. 1, 2014

(65) Prior Publication Data

US 2016/0000228 A1 Jan. 7, 2016

(51) Int. Cl.

| | |
|---|---|
| ***A47C 7/62*** | (2006.01) |
| ***A47C 1/14*** | (2006.01) |
| ***A45C 5/14*** | (2006.01) |
| ***A45C 9/00*** | (2006.01) |
| ***A45C 11/20*** | (2006.01) |
| ***B65D 81/38*** | (2006.01) |
| ***A45C 13/26*** | (2006.01) |

(52) U.S. Cl.

CPC ... *A47C 7/62* (2013.01); *A45C 5/14* (2013.01); *A45C 9/00* (2013.01); *A45C 11/20* (2013.01); *A45C 13/262* (2013.01); *A47C 1/14* (2013.01); *B65D 81/38* (2013.01); *A45C 2009/002* (2013.01)

(58) Field of Classification Search

CPC ..... A47C 7/62
USPC ..... 297/188.1, 188.11, 188.04
See application file for complete search history.

(56) References Cited

U.S. PATENT DOCUMENTS

| | | | | | |
|---|---|---|---|---|---|
| 3,230,006 | A * | 1/1966 | Sokolis | A01K 97/22 | 297/188.1 |
| 3,290,089 | A * | 12/1966 | Farrell | A47C 4/48 | 297/188.02 |
| 3,399,925 | A * | 9/1968 | Levy | A47B 83/008 | 248/456 |
| 4,971,390 | A * | 11/1990 | McGinley | A47C 7/62 | 297/188.11 |
| 5,100,198 | A * | 3/1992 | Baltzell | A47C 7/74 | 280/30 |
| 5,139,308 | A * | 8/1992 | Ziman | A47C 7/62 | 224/155 |
| 5,269,157 | A * | 12/1993 | Ciminelli | A45B 11/00 | 280/47.18 |
| 5,395,157 | A * | 3/1995 | Rollo | A47C 1/14 | 297/183.1 |
| 5,641,197 | A * | 6/1997 | Springmann | A47C 7/66 | 248/512 |
| 5,727,843 | A * | 3/1998 | LaTrace | A61G 5/10 | 297/188.1 |
| 5,727,844 | A * | 3/1998 | O'Quinn | A47C 7/744 | 206/216 |
| 6,000,752 | A * | 12/1999 | Shyr | A47C 4/38 | 297/129 |
| 6,036,262 | A * | 3/2000 | Shahid | A47C 1/143 | 297/184.15 |
| 6,341,817 | B1 * | 1/2002 | Stern-Gonzalez | A47C 3/16 | 297/188.09 |
| 7,475,889 | B2 * | 1/2009 | Marmah | A47C 1/14 | 280/30 |
| 7,604,290 | B1 * | 10/2009 | Giordano | A47C 3/32 | 220/915.2 |
| 2006/0261654 | A1 * | 11/2006 | Stallman | A47C 15/004 | 297/310 |

* cited by examiner

*Primary Examiner* — David E Allred
*Assistant Examiner* — Alexander Harrison
(74) *Attorney, Agent, or Firm* — Tiffany C. Miller; Inventions International Inc.

(57) ABSTRACT

A lounge chair equipped with wheels and is configured to be foldable by a user and has an integrated storage compartment with a locking mechanism. At least one storage compartment is integrated within the lounge chair. A user can access the storage compartment from the top of the storage housing when the seat portion is lifted to an open configuration or from the side of the storage housing when a user pulls out the storage housing drawer. When the seat portion is lowered to a closed position, a user is able to then sit on the seat portion and access at least a portion of a storage area through a pull-out drawer located on the side of the storage housing of the novel lounge chair. A handle portion can telescope from a closed configuration during storage to an open configuration when grasped by a user.

8 Claims, 7 Drawing Sheets

FOLDABLE AND PORTABLE LOUNGE CHAIR HAVING AN INTEGRATED LOCKABLE STORAGE COMPARTMENT

BACKGROUND OF THE INVENTION

1. Field of the Invention

The novel invention relates, generally, to a foldable and portable lounge chair. More particularly, it relates to a lounge chair having a plurality of integrated storage compartments configured to be secured with a locking mechanism.

2. Background Art

Prior art lounge chairs are foldable to allow a user to fold and transport the lounge chair to a desired location. A user preparing to go to a recreational area such as a park or a beach often wants to bring more than just a lounge chair with them to make their recreational experience more comfortable. A user can bring personal items such as a towel, an electronic device, a wallet, money, a key, a cold beverage, ice, or an umbrella with them to a recreational area. It is more desirable for a user to be able to conveniently store and transport all of their desired personal items within the novel lounge chair. Thus, there is a need for a lounge chair with wheels having a plurality of integrated storage compartments for the safe storage, convenient accessibility, and the increased portability of many personal items that are commonly individually transported.

Prior art lounge chairs are not adapted to have integrated storage compartments within the structure of the lounge chair. By incorporating a plurality of storage areas within the lounge chair, a user can discretely store all of their desired personal items within these storage areas. More particularly, prior art lounge chairs do not have integrated storage compartments that are insulated. An insulated storage compartment integrally located within the lounge chair is beneficial to a user when a user wants to keep beverages cool and within arm's reach while lying on the lounge chair.

Additionally, it is more desirable that the lounge chair is configured to roll resulting in a user pushing or pulling the lounge chair during transportation rather than struggling with carrying the lounge chair. When a user struggles to carry all of their belongings, some of the belongings can be left behind or fall from the grasp of a user resulting in damage or loss of these items. When a user's personal items are secured within an integrated storage compartment of the novel lounge chair, the novel lounge chair and the stored personal items can be easily rolled to a desired location. The rolling of the lounge chair results in less strain on a user's back because the user does not have to carry the combined weight of the lounge chair and all of their personal belongings.

Prior art coolers are adapted to come into contact with the external environment such as sand from the beach. When these prior art coolers are in contact with environmental elements such as heated sand and direct sunlight, these elements could adversely affect the quality of the cooling of the items in the cooler. This can result in the ice in the cooler melting quickly which can warm the contents of the cooler, requiring a user to constantly refill the cooler with ice to maintain a cool temperature. Thus, there is a need for a novel lounge chair having a cooler with a thermal insulating barrier located between the cooler and the external environment to prevent the cooled contents of the cooler from being compromised.

According to Morel, Laura C. "Bay area beach-blanket thieves spike." *Tampa Bay Times*. 1 Aug. 2013. Web., during the summertime, there is an increase in patrons attending the beach. This coincides with an increase in beach related thefts of unattended personal items left behind on the beach while the victims are swimming. Commonly known as beach blanket thefts, the most sought after unattended items that are stolen from beach patrons include, but are not limited to, money, electronic devices, keys, and credit cards. It is more desirable for a user to secure these unattended items within a locked compartment within the novel lounge chair so that a thief does not have the opportunity to steal them. Thus, there is a need for a lounge chair having an integrated storage compartment with a locking mechanism adapted to receive and secure personal items.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a lounge chair equipped with wheels and configured to be folded by a user having an integrated storage compartment with a locking mechanism and having an insulated storage compartment integrated within the lounge chair which also includes improvements that overcome the limitations of prior art lounge chairs is now met by a new, useful, and non-obvious invention.

The novel invention includes a portable lounge chair having wheels and a handle. The handle portion can telescope from a closed configuration during storage to an open configuration when being grasped by a user during transportation or when in use. A user can grasp the handle and pivot the lounge chair onto its wheels to be pushed or pulled to a desired location.

In another embodiment, the novel lounge chair has an umbrella shaft securing device connected thereto. This umbrella securing device has a housing having an opening located on an end of the housing. The opening receives an end portion of the umbrella shaft. The housing can have a latching mechanism that secures a portion of the umbrella shaft within the housing. This umbrella securing device eliminates the need for a user to dig a hole into the sand to stabilize and secure the shaft of an umbrella in place. Additionally, the umbrella securing device is configured to secure an umbrella in an upright position during weather conditions such as strong winds. It is within the scope of this invention for the housing to be adapted to receive the shaft of including, but not limited to, a flag or an umbrella.

In another embodiment, the novel lounge chair has an adjustable head portion, foot portion, and seat portion. The lounge chair is adapted for a user to manually raise and lower the head portion, the foot portion, and the seat portion to a plurality of positions. In a preferred embodiment, the plurality of positions range from including, but not limited to, 0 degrees to 180 degrees.

In yet another embodiment, the novel lounge chair has a storage area having a pocket adapted to receive and secure items such as a towel, swim wear, or an electronic device. Although it is a preferred embodiment for the storage area having a pocket to be connected to a portion of the lounge chair head portion or handle portion, it is within the scope of this invention for the storage area having a pocket to be located on any surface of the lounge chair.

In another embodiment, the novel lounge chair seat portion is hingedly connected to at least one storage compartment. The novel lounge chair seat portion is adapted for a user to lift the seat portion to an open configuration to access a storage compartment. The seat portion can be kept in an open configuration with a latching mechanism such as a hook, a latch, a spring actuated strut, or a gas charged strut. In a preferred embodiment, a plurality of storage compartments are adapted to receive personal items such as a cooler, a beverage, tanning oil, sun screen, lotion, money, a key, or an electronic device.

It is within the scope of this invention for a storage compartment to be insulated. The insulated storage compartment is adapted to receive ice and beverages. A user can access the storage compartment from the top of the storage housing when the seat portion is lifted to an open configuration or from the side of the storage housing when a user pulls out the storage housing drawer. When the seat portion is lowered to a closed position, a user is able to then sit on the seat portion and access at least a portion of a storage area through a pull-out drawer located on the side of the storage housing of the novel lounge chair. For example, when the drawer is pulled out, the inside of the cooler or insulated storage area is exposed for a user to retrieve an item such as a cold beverage.

In another embodiment, the novel lounge chair can have at least one cup holder located on a surface of the lounge chair. The cup holders are adapted to secure items such as a can, a bottle, or a cup to the lounge chair.

In an alternate embodiment, the novel lounge chair includes a storage area having a locking mechanism such as a combination lock, a lock and key, or an electronic lock. At least a portion of a storage area is secured with a lock to prevent theft of valuable personal items. It is within the scope of this invention for the locking mechanism to have a cover to protect the locking mechanism from being contaminated with foreign debris such as water, dirt, or sand.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
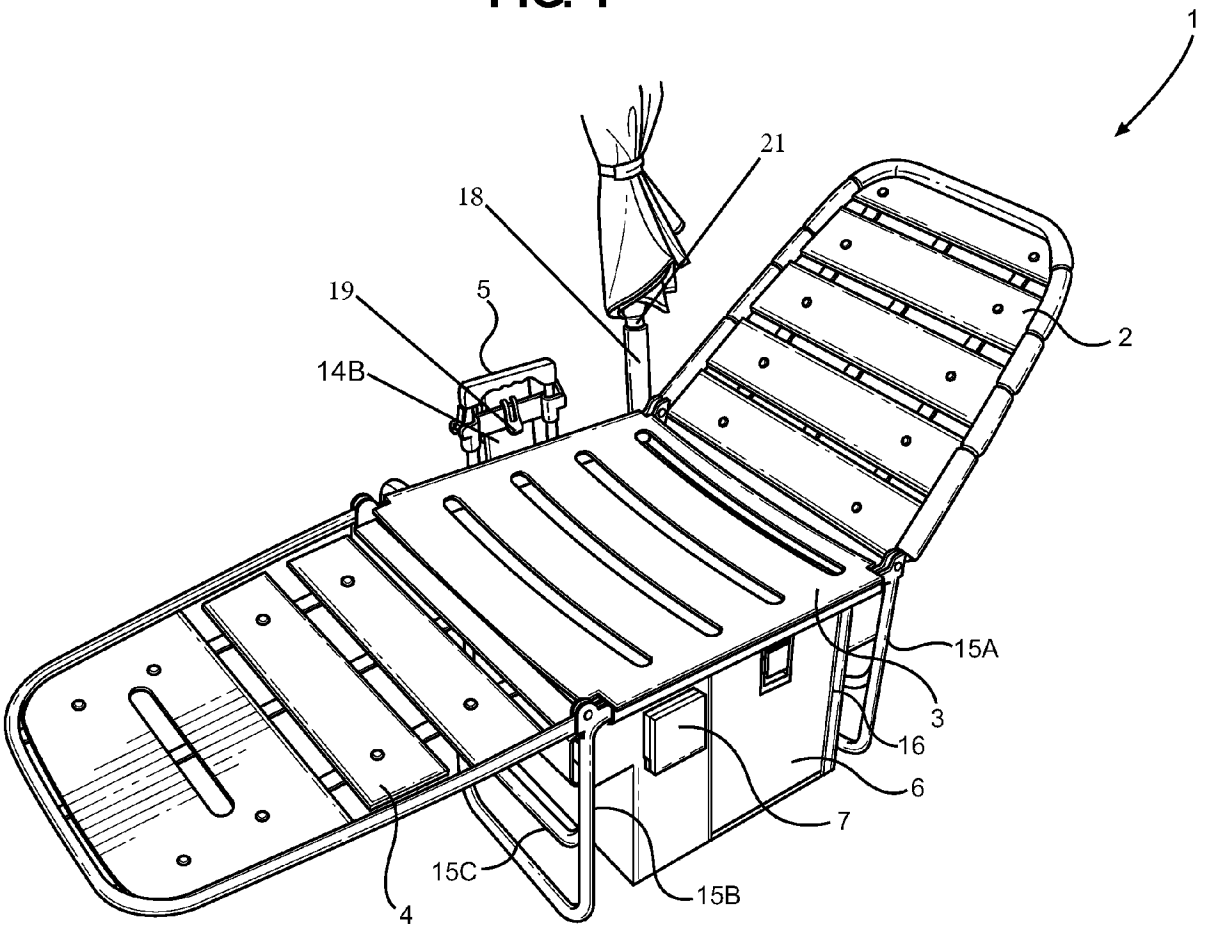
FIG. 1 is a perspective view of the novel lounge chair having an open configuration.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

In a general embodiment the novel lounge chair has a storage structure having at least one integrated storage compartment. The storage compartment has a bottom structure. The bottom structure is connected to at least one perimeter wall. In a preferred embodiment, the bottom structure 25 is connected to four perimeter walls 22, 26, 29, and 32 forming a square or a rectangular shape. It is within the scope of this invention for the bottom structure to be connected to only one perimeter wall forming a cylindrical shape. A primary support structure has an end that is hingedly connected to a portion of the perimeter wall structure. The primary support structure 2 is adapted to support a user's upper half of their body including, but not limited to their, torso, waist, back, or head. A secondary support structure 3 has an end that is hingedly connected to a portion of the perimeter wall structure. The secondary support structure 3 can pivot on a hinge point to allow access to the storage compartment. The secondary support structure 3 is adapted to support the weight of a user sitting on the secondary support structure 3. A tertiary support structure 4 has an end that is hingedly connected to a portion of the perimeter wall structure. The tertiary support structure 4 is adapted to support a user's bottom half of their body including, but not limited to their, legs and feet.

In an alternate embodiment, the novel lounge chair has a storage structure having at least one wheel having an axle connected to a wall of the storage structure. It is a preferred embodiment for a wheel having an axle to be connected on both sides of the storage structure.

In another embodiment, the novel lounge chair has a storage structure having a cover structure located between the secondary support structure and the bottom structure. The storage structure can have a locking mechanism that is connected to the cover structure. This locking mechanism can have a cover.

In another embodiment, the novel lounge chair has at least one integrated storage compartment having a cover structure located between the secondary support structure and the bottom structure. The storage structure can have a locking mechanism that is connected to the cover structure. This locking mechanism can have a cover.

In another embodiment, the novel lounge chair has a storage structure having a plurality of storage compartments. The plurality of storage compartments can have a variety of sizes and shapes.

In another embodiment, the novel lounge chair has at least one drawer associated with the storage structure. In a preferred embodiment, the drawer is adapted for a user to pull the drawer from the storage structure to access an item that was stored inside the storage structure.

In yet another embodiment, the novel lounge chair has a pocket connected to a surface of the lounge chair. The pocket is configured to receive an item. It is within the scope of this invention for the pocket to be connected by an attaching element including, but not limited to, a fastener, a clip, a button, or a hook and loop attachment to a wall of the storage structure.

Another embodiment includes the novel lounge chair having a storage structure having a housing connected to a surface of the storage structure. The housing is configured to receive a shaft including, but not limited to, an umbrella base or a flag pole.

Another embodiment includes the novel lounge chair having a storage structure having at least one cup holder connected to a wall of the storage structure.

Another embodiment includes the novel lounge chair having a storage structure having a handle connected to a wall of the storage structure. In a preferred embodiment the handle is adjustable from a closed position to an open configuration.

Another embodiment includes the novel lounge chair having a storage structure having a thermal insulating barrier. The insulating barrier is capable of slowing the transfer of heat. Although a preferred embodiment includes the storage area of the storage housing being adapted to receive a cooler, it is also within the scope of this invention for the storage structure having a thermal insulating barrier to receive items such as beverages and ice to keep them cool without having to receive a cooler.

Construction of the Novel Lounge Chair

Figure 5:
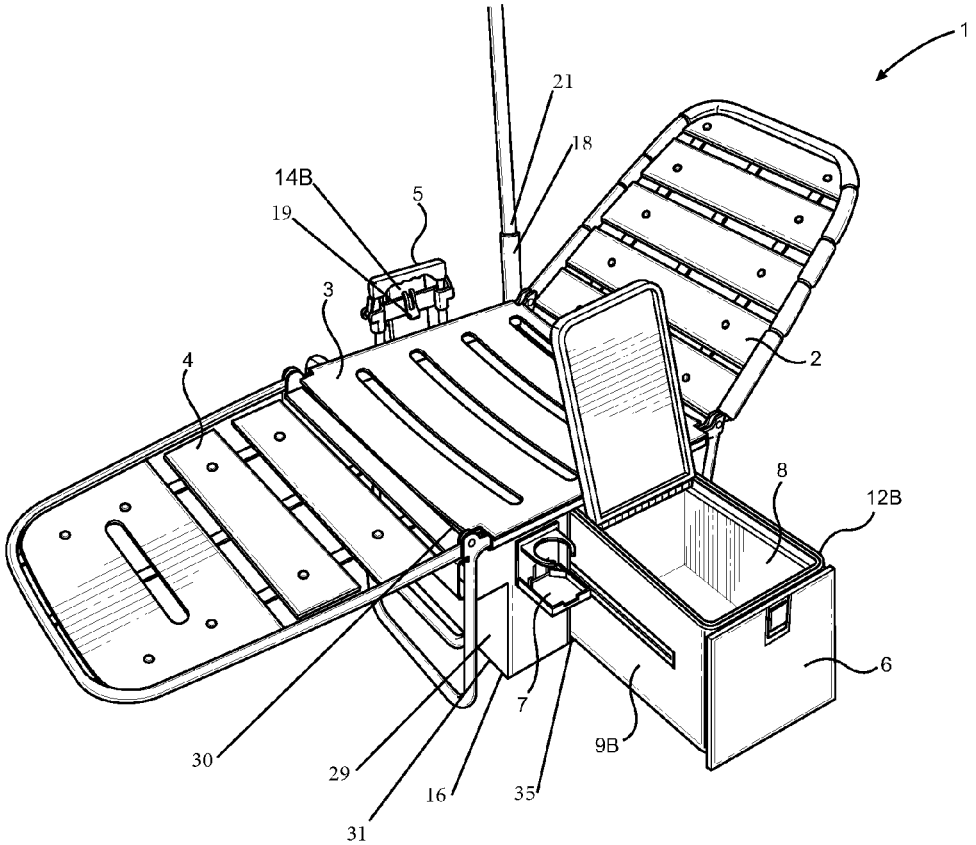
FIG. 5 is a perspective view of the novel lounge chair having a drawer that is opened to expose a secondary storage area capable of receiving a cooler.
Figure 7:
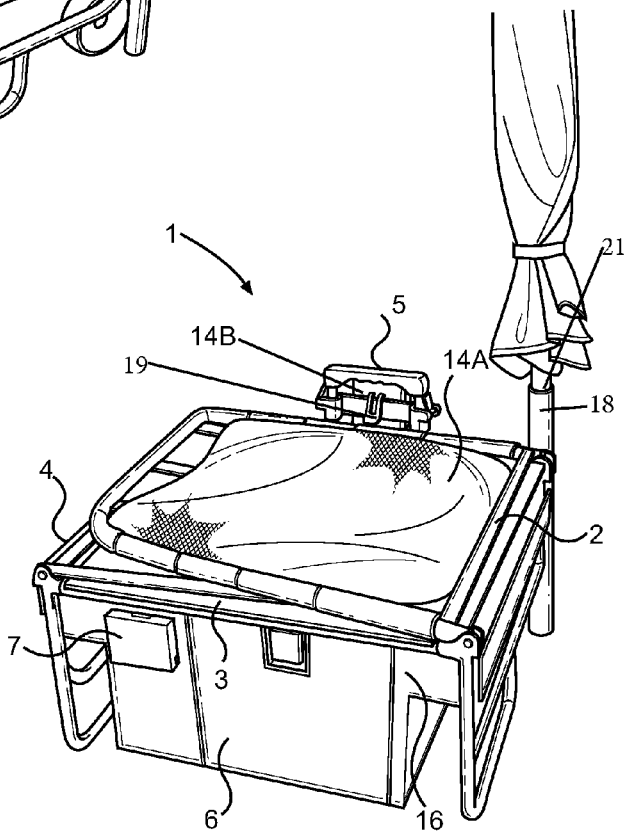
FIG. 7 is a perspective view of the novel lounge chair primary storage area, secondary storage area, and tertiary storage area being in a folded configuration.

It will now be seen, referring to FIGS. 1-3, 5, and 7 novel lounge chair 1 has head portion 2 having an end that is hingedly connected to storage housing 16. Lounge chair 1 has foot portion 4 having an end that is hingedly connected to storage housing 16. Lounge chair 1 has seat portion 3 having an end that is hingedly connected to storage housing 16. FIG. 7 best illustrates head portion 2, seat portion 3, and foot portion 4 are all configured to be folded over storage area 16 when storage housing 16 has a closed configuration. Items (not shown) stored in storage housing 16 can be accessed when a user (not shown) pulls drawer 6 from storage housing 16. Handle 5 (FIGS. 1, 5, and 7) is connected to a portion of storage housing 16. Cup holder 7 is located on a surface of storage housing 16. FIGS. 1, 5, and 7 illustrate securing device 18 having at least one opening 20 (FIG. 8) located on an end of securing device 18 that is adapted to receive the shaft portion 21 of an umbrella.

Figure 2:
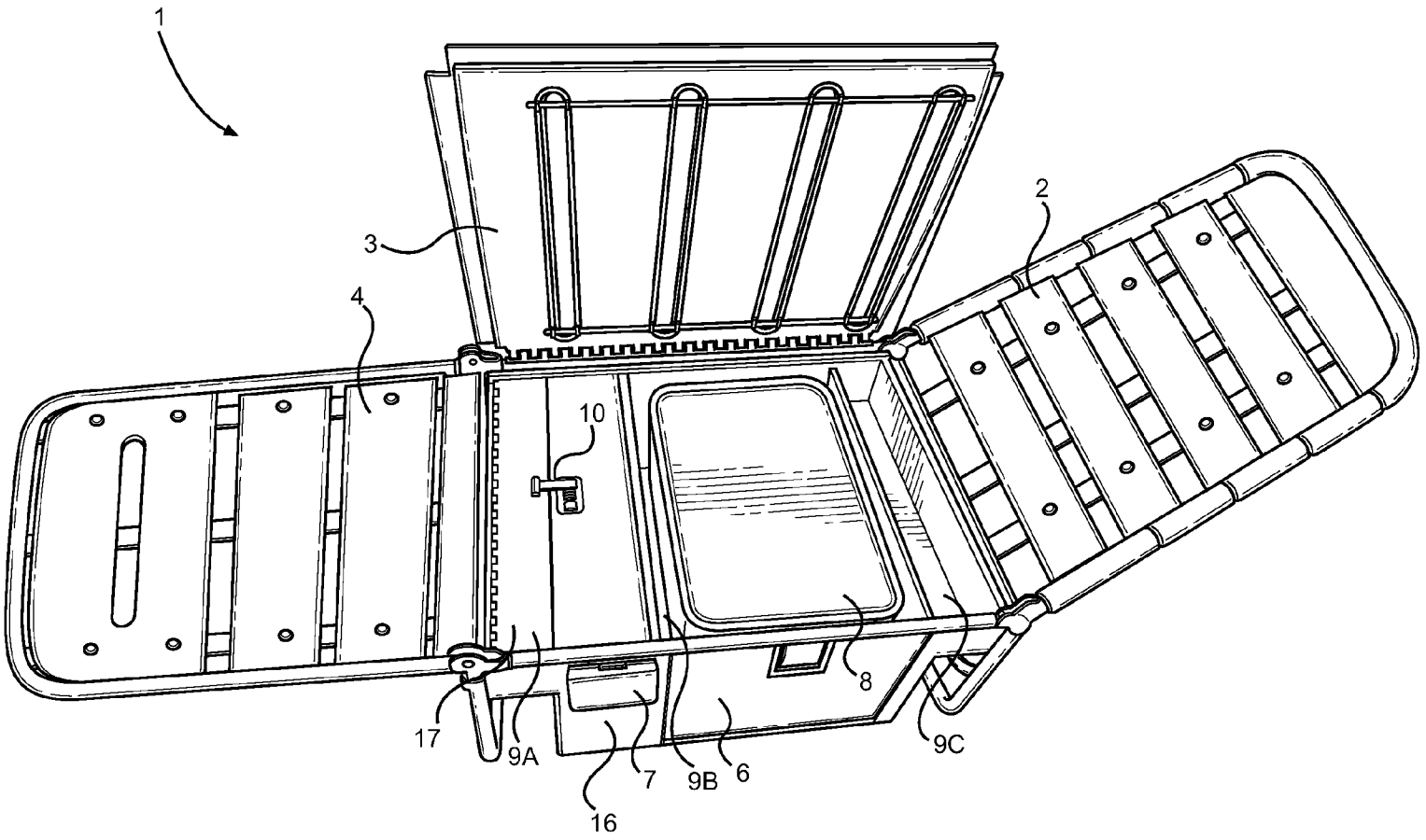
FIG. 2 is a perspective view of the novel lounge chair primary storage area, secondary storage area, and tertiary storage area.

FIG. 2 depicts storage housing 16 having primary storage area 9A, secondary storage area 9B, and tertiary storage area 9C. Primary storage area 9A has primary cover 17. Primary cover 17 is secured in a closed position with locking mechanism 10 connected to a portion of a surface of primary cover 17. Secondary storage area 9B is adapted to receive cooler 8. It is within the scope of this invention for secondary storage area 9B to have insulated walls (not shown) for storing and keeping beverages cold without the additional step of inserting a cooler into secondary storage area 9B. Tertiary storage area 9C has secondary cover (not shown). It is within the scope of this invention for a storage area to have a plurality of compartments (not shown) located within each storage area for the organization of personal items.

Figure 3:
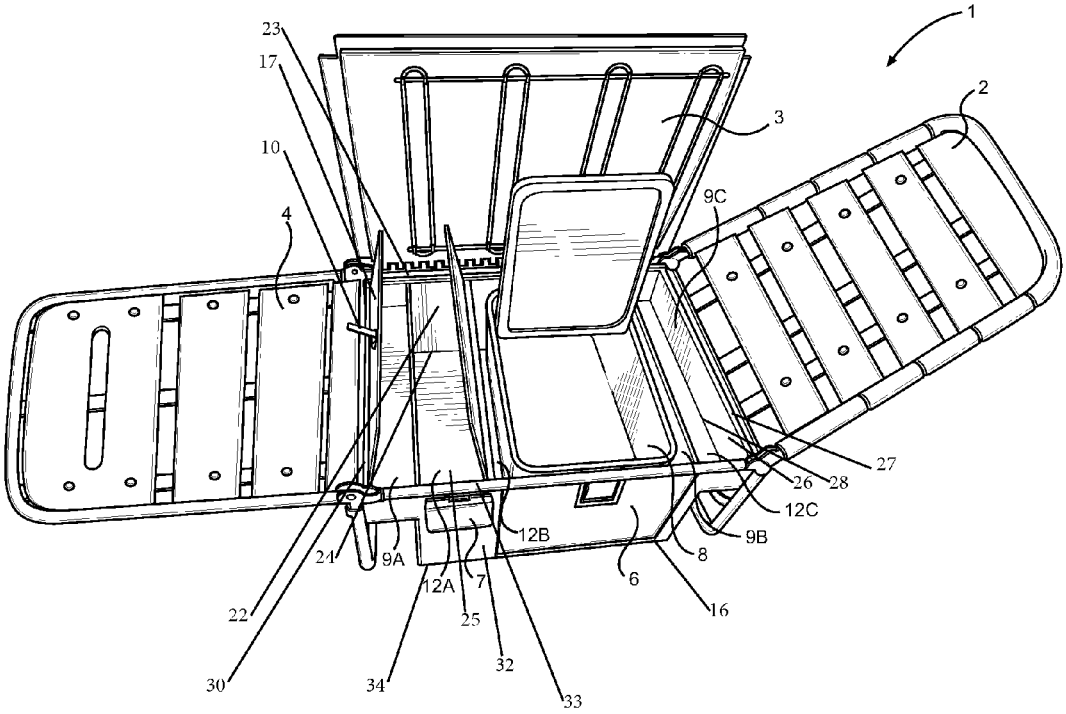
FIG. 3 is a perspective view of the novel lounge chair primary storage area having an opening, the secondary storage area having an opening, and the tertiary storage area having an opening.

FIG. 3 illustrates primary storage area 9A having primary opening 12A. Secondary storage area 9B having secondary opening 12B. Secondary opening 12B is adapted to receive cooler 8.Tertiary storage area 9C has tertiary opening 12C. Primary cover 17 is depicted in an opened configuration with locking mechanism 10 connected to a portion of a surface of primary cover 17. Storage structure 16 has primary wall 26 having primary outer perimeter edge 27 located opposite primary wall lower end 28. Secondary wall 22 has secondary outer perimeter edge 23 located opposite secondary wall lower end 24. Tertiary wall 29 has tertiary outer perimeter edge 30 located opposite tertiary wall lower end 31. Quaternary wall 32 has quaternary outer perimeter edge 33 located opposite quaternary wall lower end 34 as illustrated in FIGS. 3 and 5.

Figure 4:
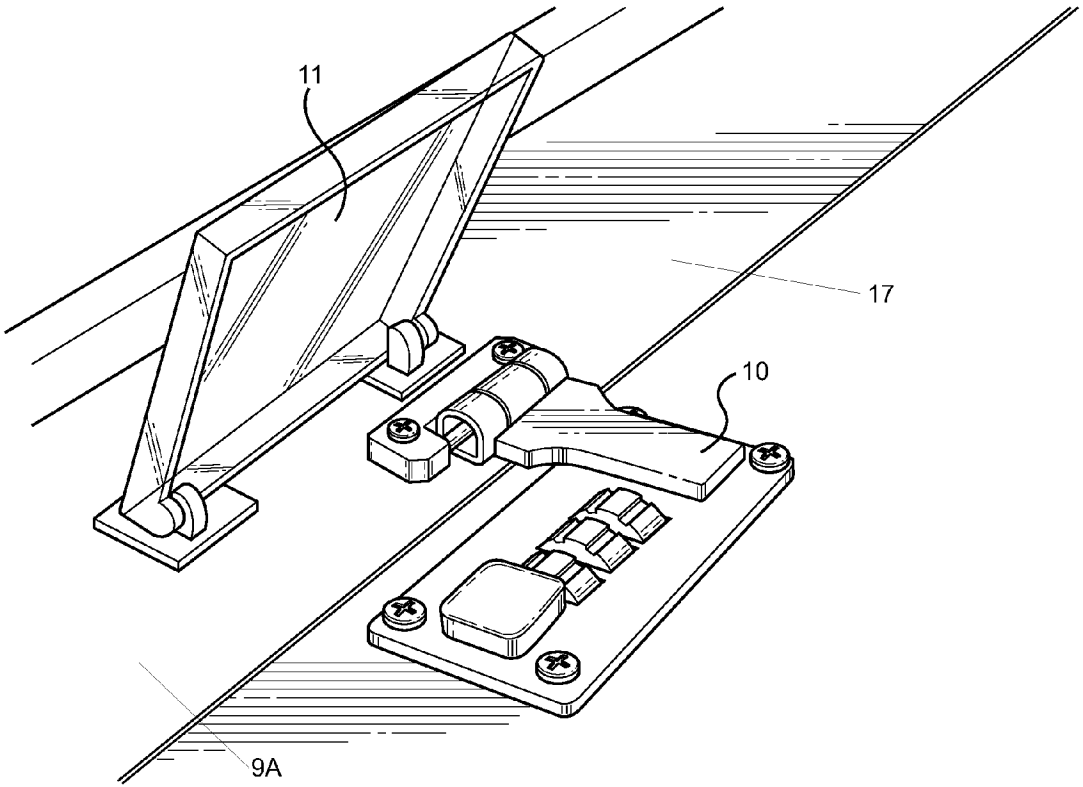
FIG. 4 is a perspective side view of the novel lounge chair primary storage area having a locking mechanism and a cover.

FIG. 4 shows cover 17 of primary storage area 9A having locking mechanism 10 located on a surface of cover 17. Barrier element 11 is adapted to have an end that is hingedly connected to a surface of cover 17. Barrier element 11 is foldable over locking mechanism 10. When barrier element 11 is folded over locking mechanism 10, a seal is created between cover 17 and barrier element 11. It is within the scope of this invention for a plurality of locking mechanisms (not shown) to be located on a plurality of storage area covers (not shown).

FIG. 5 shows that when drawer 6 is pulled out of storage housing 16 through tertiary opening 35, cooler 8 is accessible to a user (not shown). Cooler 8 is located in secondary opening 12B of secondary storage area 9B.

Figure 6:
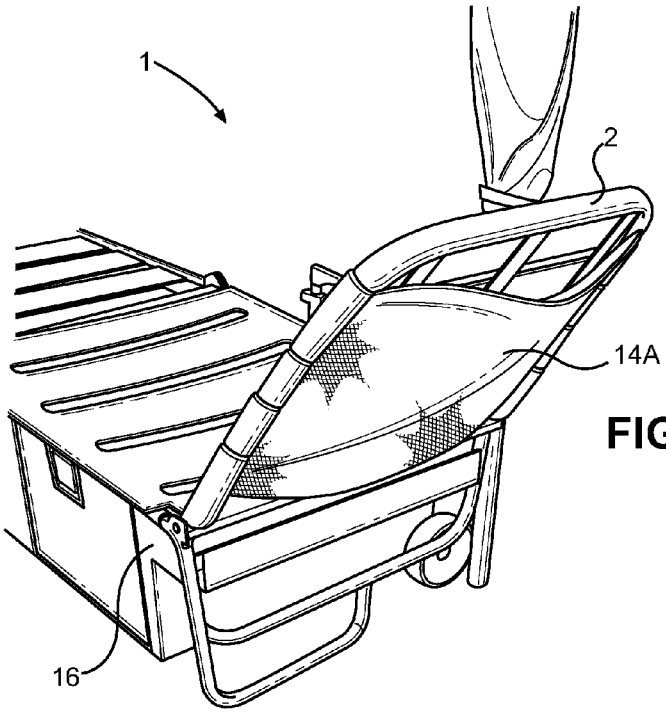
FIG. 6 is a perspective view of the novel lounge chair connected to a storage area having a pocket.

FIGS. 6 and 7 depict lounge chair 1 having storage pocket 14A connected to head portion 2. It is within the scope of this invention for the storage pocket to be connected to any surface of lounge chair 1 or storage housing 16. FIGS. 1, 5, and 7 depict handle 5 having storage pocket 14B connected to handle 5 with attaching element 19 including, but not limited to, a clip, a button, or a hook and loop attachment.

Figure 8:
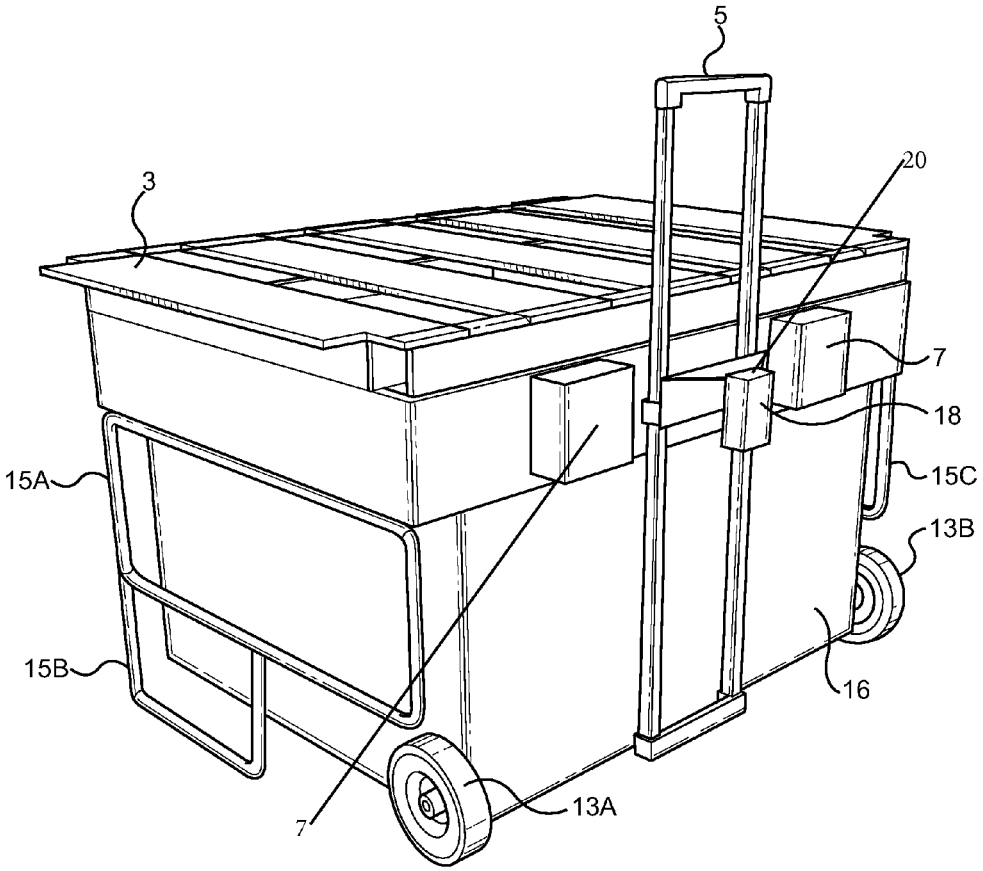
FIG. 8 is a perspective view of the novel lounge chair having a handle portion, wheels, support structures, and cup holders.

FIG. 8 depicts storage housing 16 having wheels 13A and 13B connected to a surface of storage housing 16. Handle 5 is connected to a surface of storage housing 16. Securing device 18 has at least one opening 20 located on an end of securing device 18 that is adapted to receive the shaft portion of an umbrella (not shown). Cup holders 7 are connected to a surface of storage housing 16. Seat portion 3 has an end that is hingedly connected to storage housing 16. FIGS. 1 and 8 show support structures 15A, 15B, and 15C. Support structures 15A, 15B, and 15C secure head portion 2 and foot portion 4 to storage housing 16. It is within the scope of this invention for lounge chair 1 to not have structures 15A, 15B, and 15C and that an end of the head portion and the foot portion can connect directly to storage housing 16.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A lounge chair, comprising:

a storage structure comprising:

a first wall having a first outer perimeter edge located opposite a first wall lower end;

a second wall having a second outer perimeter edge located opposite a second wall lower end;

a third wall having a third outer perimeter edge located opposite a third wall lower end;

a fourth wall having a fourth outer perimeter edge located opposite a fourth wall lower end;

a bottom wall having a first side, a second side, a third side, and a fourth side, said first side of said bottom wall is connected to said first wall lower end, said second side of said bottom wall is connected to said second wall lower end, said third side of said bottom wall is connected to said third wall lower end, said fourth side of said bottom wall is connected to said fourth wall lower end;

a first storage compartment configured to retain at least one item comprising, a first compartment first opening, a cover oriented to overlay said first compartment first opening, a locking mechanism connected to a surface of said cover;

a second storage compartment comprising, a second storage compartment second opening and a second storage compartment third opening, whereby, said second storage compartment second opening is located perpendicular to said second storage compartment third opening, a drawer retained in said second storage compartment, said drawer is adapted to extend and retract from said second storage compartment through said second storage compartment third opening;

a first support structure having an end hingedly connected to said first outer perimeter edge of said first wall, whereby, said first support structure having a first closed configuration, whereby, said first support structure is oriented to overlay said storage structure;

a second support structure having an end hingedly connected to said second outer perimeter edge of said second wall, said second support structure having a second closed configuration, whereby, said second support structure is oriented to overlay both of said cover of said first compartment opening and said second storage compartment second opening, said second support structure having an open configuration adapted for a user to access both of said cover of said first compartment opening and said second storage compartment second opening; and a third support structure having an end hingedly connected to said third outer perimeter edge of said third wall, whereby, said third support structure having a third closed configuration, whereby, said third support structure is oriented to overlay said storage structure.

2. The lounge chair of claim 1, wherein said storage structure having at least one wheel, said at least one wheel having an axle connected to a wall of said storage structure.

3. The lounge chair of claim 1, further comprising said locking mechanism having a cover.

4. The lounge chair of claim 1, wherein said lounge chair having a pocket, said pocket connected to a surface of said lounge chair, whereby, said pocket is configured to receive an item.

5. The lounge chair of claim 1, wherein said storage structure having a housing, said housing connected to a surface of said storage structure, whereby, said housing is configured support a shaft.

6. The lounge chair of claim 1, wherein said storage structure having at least one cup holder, said at least one cup holder connected to a wall of said storage structure.

7. The lounge chair of claim 1, wherein said storage structure having a handle, said handle connected to a wall of said storage structure.

8. The lounge chair of claim 1, wherein said storage structure having a thermal insulating barrier.

* * * * *